US008562231B2

(12) United States Patent
Maeda et al.

(10) Patent No.: US 8,562,231 B2
(45) Date of Patent: Oct. 22, 2013

(54) PRINTER WITH INDEPENDENTLY SUPPORTED PRINT UNIT AND LID

(75) Inventors: Hideyuki Maeda, Tokyo (JP); Hiroshi Kokuta, Tokyo (JP)

(73) Assignee: Sato Holdings Kabushiki Kaisha (JP)

( * ) Notice: Subject to any disclaimer, the term of this patent is extended or adjusted under 35 U.S.C. 154(b) by 246 days.

(21) Appl. No.: 12/991,242

(22) PCT Filed: Dec. 2, 2008

(86) PCT No.: PCT/JP2008/071854

§ 371 (c)(1),
(2), (4) Date: Nov. 5, 2010

(87) PCT Pub. No.: WO2009/144851

PCT Pub. Date: Dec. 3, 2009

(65) Prior Publication Data

US 2011/0058878 A1 Mar. 10, 2011

(30) Foreign Application Priority Data

May 29, 2008 (JP) ..... 2008-141554
May 29, 2008 (JP) ..... 2008-141555
May 29, 2008 (JP) ..... 2008-141557

(51) Int. Cl.
*B41J 29/02* (2006.01)
*B41J 29/13* (2006.01)

(52) U.S. Cl.
USPC ..... 400/663; 400/207; 400/208; 400/668; 347/222

(58) Field of Classification Search
USPC ..... 400/693, 693.1, 120.16, 663, 664, 668; 347/222
See application file for complete search history.

(56) References Cited

U.S. PATENT DOCUMENTS 6,494,631 B1 * 12/2002 Mastinick ..... 400/208
7,651,287 B2 * 1/2010 Numata et al. ..... 400/120.01

FOREIGN PATENT DOCUMENTS

EP 2108517 10/2009
EP 2241443 10/2010

(Continued)

OTHER PUBLICATIONS

International Search Report dated Jan. 20, 2009, issued in corresponding international application No. PCT/JP2008/071854.

*Primary Examiner* — Ren Yan
*Assistant Examiner* — Justin Olamit
(74) *Attorney, Agent, or Firm* — Ostrolenk Faber LLP

(57) ABSTRACT

A thermal printer in which an upper lid portion and a printing unit can be opened off a main body of the printer by a single operation and the upper lid portion is not closed even when a closing direction force is exerted on the printing unit during ink ribbon replacement. The upper lid portion has a stopper 34 that supports an upper lid portion 30 in a predetermined rotative position relative to a main body 20 and releases support of the upper lid portion 30 when the upper lid portion 30 is closed. A unit stopper 44 supports a printing unit 40 relative to the main body 20 at a smaller rotation angle than the upper lid portion 30 and releases support of the printing unit 40 when the printing unit 40 is closed. A connecting member 35 connects the upper lid portion 30 and the printing unit 40 in a fitted state where the printing unit 40 is fitted to the upper lid portion 30. In a state where the upper lid portion 30 and the printing unit 40 are closed, the upper lid portion 30 and the printing unit 40 are connected by the connecting member 35.

4 Claims, 13 Drawing Sheets

(56) References Cited

FOREIGN PATENT DOCUMENTS

| | | |
|---|---|---|
| JP | 60-245574 A | 12/1985 |
| JP | 63-315280 | 12/1988 |
| JP | 2000-137419 | 5/2000 |
| JP | 2004-209722 A | 7/2004 |
| JP | 2005-81729 | 3/2005 |
| JP | 2005-141111 | 6/2005 |
| JP | 2006-123191 | 5/2006 |

* cited by examiner (a)

(b)

(a)

(b)

(a)

(b)

(a)

(b)

(a)

(b)

PRINTER WITH INDEPENDENTLY SUPPORTED PRINT UNIT AND LID

CROSS REFERENCE TO RELATED APPLICATION(S)

The present application is a 35 U.S.C. §371 National Phase conversion of PCT/JP2008/071854, filed Dec. 2, 2008, which claims benefit of Japanese Application No. 2008-141554, filed May 29, 2008, Japanese Application No. 2008-141555, filed May 29, 2008 and Japanese Application No. 2008-141557, filed May 29, 2008, the contents of which are incorporated herein by reference. The PCT International Application was published in the Japanese language.

TECHNICAL FIELD

The present invention relates to a thermal printer that performs printing using a thermal head, and more particularly to a thermal printer that performs printing by overlapping an ink ribbon and a printing medium and conveying the overlapped ink ribbon and printing medium between a platen roller and a thermal head in a sandwiched fashion such that ink is transferred onto the printing medium from the ink ribbon.

BACKGROUND ART

A conventional thermal printer prints predetermined printing information onto a printing medium. Such a medium is, for example, a label continuous body or a tag continuous body. The printing is done by overlapping the printing medium and an ink ribbon suspended between a ribbon winding shaft and a ribbon supply shaft and conveying the overlapped printing medium and ink ribbon in a sandwiched fashion. A printing unit including a thermal head, the ribbon winding shaft, and the ribbon supply shaft is disposed between a main body and an upper lid portion. The upper lid portion and the printing unit are supported by a support shaft to be free to rotate. Thus, by opening the upper lid portion and the printing unit, the printing medium or the ink ribbon can be replaced (see Japanese Patent Application Publication No. 2005-81729 for example).

Typically in this type of thermal printer, when the ink ribbon is replaced, or in other words when a new ink ribbon is suspended between the ribbon winding shaft and the ribbon supply shaft via the thermal head, the printing unit must be supported at a smaller angle than the upper lid portion, or in other words in a ribbon replacement state in which a working space is secured above and below the printing unit. Therefore, the upper lid portion and the printing unit must be supported by different support mechanisms.

With this conventional technique, however, the upper lid portion and the printing unit are supported by different support mechanisms, and therefore, when the upper lid portion and the printing unit are opened, the upper lid portion and the printing unit must be opened individually, leading to increased operational complexity.

Further, following replacement of the ink ribbon, the printing unit can be set in a printing position easily by exerting a closing direction force on the printing unit or the upper lid portion.

However, when the closing direction force is exerted on the printing unit during replacement of the ink ribbon, the printing unit may be closed unintentionally, and in a case where the printing unit and the upper lid portion are operated in conjunction, the upper lid portion may be closed, thereby obstructing the ink ribbon replacement operation.

DISCLOSURE OF THE INVENTION

The present invention has been designed in consideration of these problems An object thereof is to provide a thermal printer in which an upper lid portion and a printing unit can be opened relative to a main body by a single operation, and the upper lid portion and the printing unit can be closed relative to the main body by a single operation of closing the upper lid portion from a ribbon replacement state in which the printing unit is supported independently of and at a smaller angle than the upper lid portion, and the printing unit and upper lid portion are not closed even when a closing direction force is exerted on the printing unit during ink ribbon replacement, with the result that an ink ribbon replacement operation is not obstructed.

To solve the problems described above, the present invention is constituted as follows.

The invention is a thermal printer that performs printing by overlapping a printing medium and an ink ribbon suspended between a ribbon winding shaft and a ribbon supply shaft and conveying the printing medium and the ink ribbon between a platen roller and a thermal head in a sandwiched fashion. A printing unit including the thermal head, the ribbon winding shaft and the ribbon supply shaft is disposed between a main body and an upper lid portion covering an upper portion of the main body. The upper lid portion and the printing unit are supported by an identical support shaft to be free to rotate. Replacement of the printing medium and the ink ribbon is performed by opening the upper lid portion and the printing unit. This is done by upper lid portion supporting means for supporting the upper lid portion in a predetermined position relative to the main body and for releasing support of the upper lid portion when a closing direction force is exerted on the upper lid portion. A printing unit supporting means supports the printing unit relative to the main body at a smaller angle than the upper lid portion and releases support of the printing unit when a closing direction force is exerted on the printing unit. Connecting means connect the upper lid portion and the printing unit in a fitted state where the printing unit is fitted to the upper lid portion. The upper lid portion and the printing unit are connected by the connecting means when the upper lid portion and the printing unit are closed.

The thermal printer connecting means releases a connection between the upper lid portion and the printing unit when the printing unit is withdrawn from the upper lid portion while the upper lid portion and the printing unit are open.

In the thermal printer, the upper lid portion supporting means is an arc-shaped member, one end portion of which is fixed to the upper lid portion and an open end side of which is inserted into an opening formed in the main body. The arc-shaped member is divided, by a slit formed at a constant width from the open end side toward the one end portion side, into a first piece which possesses elasticity and is formed with an upper lid portion stopper that supports the upper lid portion by contacting an edge portion of the opening, and a second piece. The printing unit supporting means is an arc-shaped member, one end portion of which is fixed to the printing unit and an open end side of which is inserted into the opening formed in the main body. The arc-shaped member is divided, by a slit formed at a constant width from the open end side toward the one end portion side, into a first piece which possesses elasticity and is formed with a unit stopper that supports the printing unit by contacting the edge portion of the opening, and a second piece.

The invention concerns thermal printer that performs printing by overlapping a printing medium and an ink ribbon suspended between a ribbon winding shaft and a ribbon supply shaft and conveying the printing medium and the ink ribbon between a platen roller and a thermal head in a sandwiched fashion, in which a printing unit including the thermal head, the ribbon winding shaft and the ribbon supply shaft is disposed between a main body and an upper lid portion covering an upper portion of the main body. The upper lid portion and the printing unit are supported by a support shaft to be free to rotate. Replacement of the printing medium and the ink ribbon is performed by opening the upper lid portion and the printing unit, including: upper lid portion supporting means for supporting the open upper lid portion in a predetermined position and releasing support of the upper lid portion when a closing direction force is exerted on the upper lid portion. Printing unit supporting means support the printing unit such that a working space is secured above and below the printing unit when the upper lid portion is supported by the upper lid portion supporting means. Release preventing means prevent support provided to the upper lid portion by the upper lid portion supporting means and support provided to the printing unit by the printing unit supporting means from being released when the printing unit is supported by the printing unit supporting means, even if a closing direction force is exerted on the upper lid portion and the printing unit.

In the invention, a function of the release preventing means is canceled by opening the printing unit toward the upper lid portion from a state in which the printing unit is supported by the printing unit supporting means.

In the invention, the upper lid portion supporting means is an arc-shaped member, one end portion of which is fixed to the upper lid portion and an open end side of which is inserted into an opening formed in the main body. The arc-shaped member is divided, by a slit formed at a constant width from the open end side toward the one end portion side, into a first piece which possesses elasticity and is formed with an upper lid portion stopper that supports the upper lid portion by contacting an edge portion of the opening, and a second piece. The release preventing means is projecting means provided on the printing unit and inserted movably into the slit so as to inhibit the elasticity of the first piece when the printing unit is supported by the printing unit supporting means.

The thermal printer according to the present invention is provided with the upper lid portion supporting means for supporting the upper lid portion in a predetermined position relative to the main body and releasing support of the upper lid portion when a closing direction force is exerted on the upper lid portion. The printing unit supporting means supports the printing unit relative to the main body at a smaller angle than the upper lid portion and releases support of the printing unit when a closing direction force is exerted on the printing unit. The connecting means connects the upper lid portion and the printing unit in the fitted state where the printing unit is fitted to the upper lid portion, and is constituted such that the upper lid portion and the printing unit are connected by the connecting means when the upper lid portion and the printing unit are closed. Hence, simply by opening the upper lid portion, the printing unit fitted to the upper lid portion can be opened at the same time, and therefore the upper lid portion and the printing unit can be opened relative to the main body by a single operation. Moreover, the printing unit supporting means releases support of the printing unit when a closing direction force is exerted on the printing unit. Therefore, the upper lid portion and printing unit can be closed relative to the main body by a single operation of closing the upper lid portion from a ribbon replacement state in which the printing unit is supported independently of and at a smaller angle than the upper lid portion.

In the present invention, the connecting means releases the connection between the upper lid portion and the printing unit when the printing unit is withdrawn from the upper lid portion while the upper lid portion and the printing unit are open. Therefore a state in which the printing unit is supported by the printing unit supporting means can be established by a simple operation of withdrawing the printing unit from the upper lid portion.

In the present invention, the upper lid portion supporting means supports the open upper lid portion in a predetermined position and releases support of the upper lid portion when a closing direction force is exerted on the upper lid portion. The printing unit supporting means supports the printing unit such that a working space is secured above and below the printing unit when the upper lid portion is supported by the upper lid portion supporting means, and the release preventing means for preventing the support provided to the upper lid portion by the upper lid portion supporting means and the support provided to the printing unit by the printing unit supporting means from being released when the printing unit is supported by the printing unit supporting means, even if a closing direction force is exerted on the upper lid portion and the printing unit. Therefore, where an ink ribbon replacement operation is performed while the printing unit is supported by the printing unit supporting means such that a working space is secured above and below the printing unit, the release preventing means prevents the support provided to the upper lid portion by the upper lid portion supporting means and the support provided to the printing unit by the printing unit supporting means from being released. Hence, a situation in which the printing unit and the upper lid portion are closed unintentionally by a closing direction force exerted on the printing unit during replacement of the ink ribbon can be prevented, and as a result, the ink ribbon replacement operation is not obstructed.

In the present invention, the function of the release preventing means is canceled by opening the printing unit toward the upper lid portion from the state in which the printing unit is supported by the printing unit supporting means. Therefore, following replacement of the ink ribbon, the function of the release preventing means can be canceled by a simple operation of opening the printing unit toward the upper lid portion, whereby the upper lid portion can be set in a closeable state. Moreover, by opening the printing unit toward the upper lid portion, a printing surface of the thermal head becomes visible. Therefore, a user can be encouraged to check whether the ink ribbon is suspended correctly.

PREFERRED EMBODIMENT OF THE INVENTION

Embodiments of the present invention will be described in detail below on the basis of the drawings.

Figure 1:
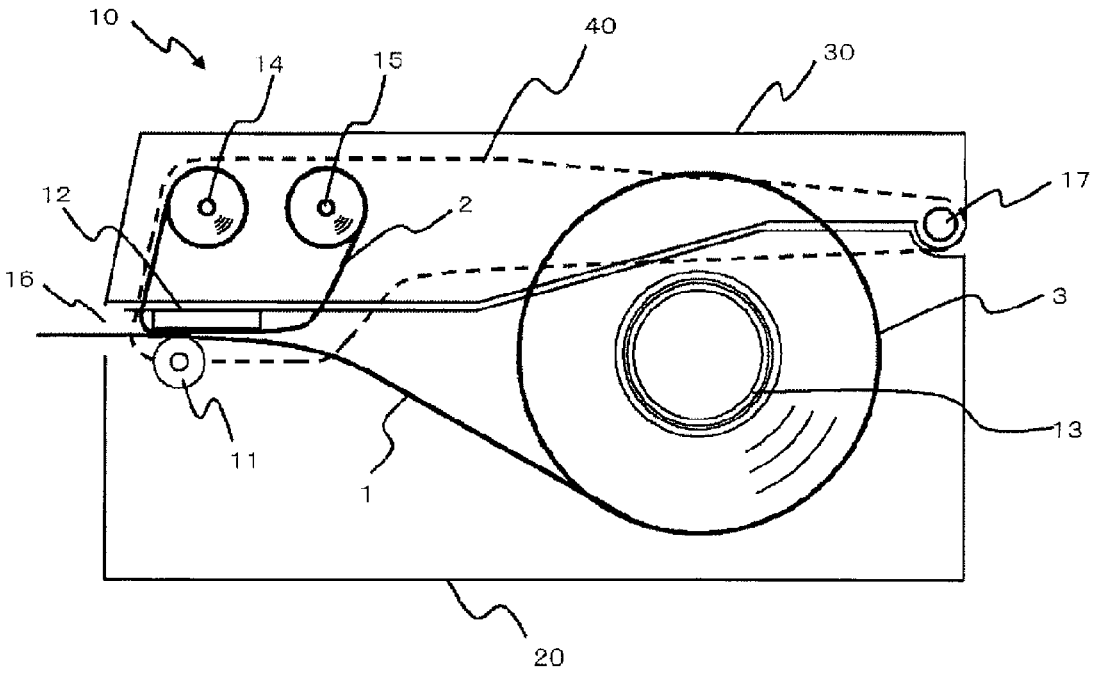
FIG. 1 is a schematic side view showing the constitution of a thermal printer according to an embodiment the present invention.

Referring to FIG. 1, a thermal printer 10 according to this embodiment includes, as a printing portion, a platen roller 11 and a thermal head 12 disposed, the thermal head comprising a surface (to be referred to hereafter as a printing surface) on which a plurality of heat generators are formed in a width direction and opposing the platen roller 11. The thermal printer 10 implements printing by overlapping a printing medium 1 such as a label continuous body in which a plurality of labels are temporarily adhered to a strip-form backing sheet and an ink ribbon 2, conveying the printing medium 1 and the ink ribbon 2 between the platen roller 11 and the thermal head 12 in a sandwiched fashion, and causing the heat generators of the thermal head 12 to generate heat selectively such that ink is transferred onto the printing medium 1 from the ink ribbon 2.

The printing medium 1 is supported on (housed in) a supply portion 13 rotatably while wound around a tubular body such as a paper tube in roll form, or in other words in the form of a roll sheet 3, and supplied between the platen roller 11 and the thermal head 12 from the supply portion 13. The ink ribbon 2 is suspended between a ribbon winding shaft 14 and a ribbon supply shaft 15 that are driven to rotate in conjunction with the platen roller 11 such that the ink ribbon 2, which is supported on the ribbon supply shaft 15 while wound into a roll shape, is supplied between the platen roller 11 and the thermal head 12 together with the printing medium 1 and then wound up by the ribbon winding shaft 14 following transfer.

The thermal printer 10 is constituted by a main body 20 that includes the platen roller 11 and supply portion 13 and has an open upper portion, an upper lid portion 30 covering the upper portion of the main body 20, and a printing unit 40 that includes the thermal head 12, the ribbon winding shaft 14, and the ribbon supply shaft 15 and is disposed between the main body 20 and the upper lid portion 30. The upper lid portion 30 and the printing unit 40 are formed to open from a front side on which a discharge port 16 for discharging printed printing media is provided, and are supported to be free to rotate by a support shaft 17 provided on a rear side of the main body 20.

Figure 2:
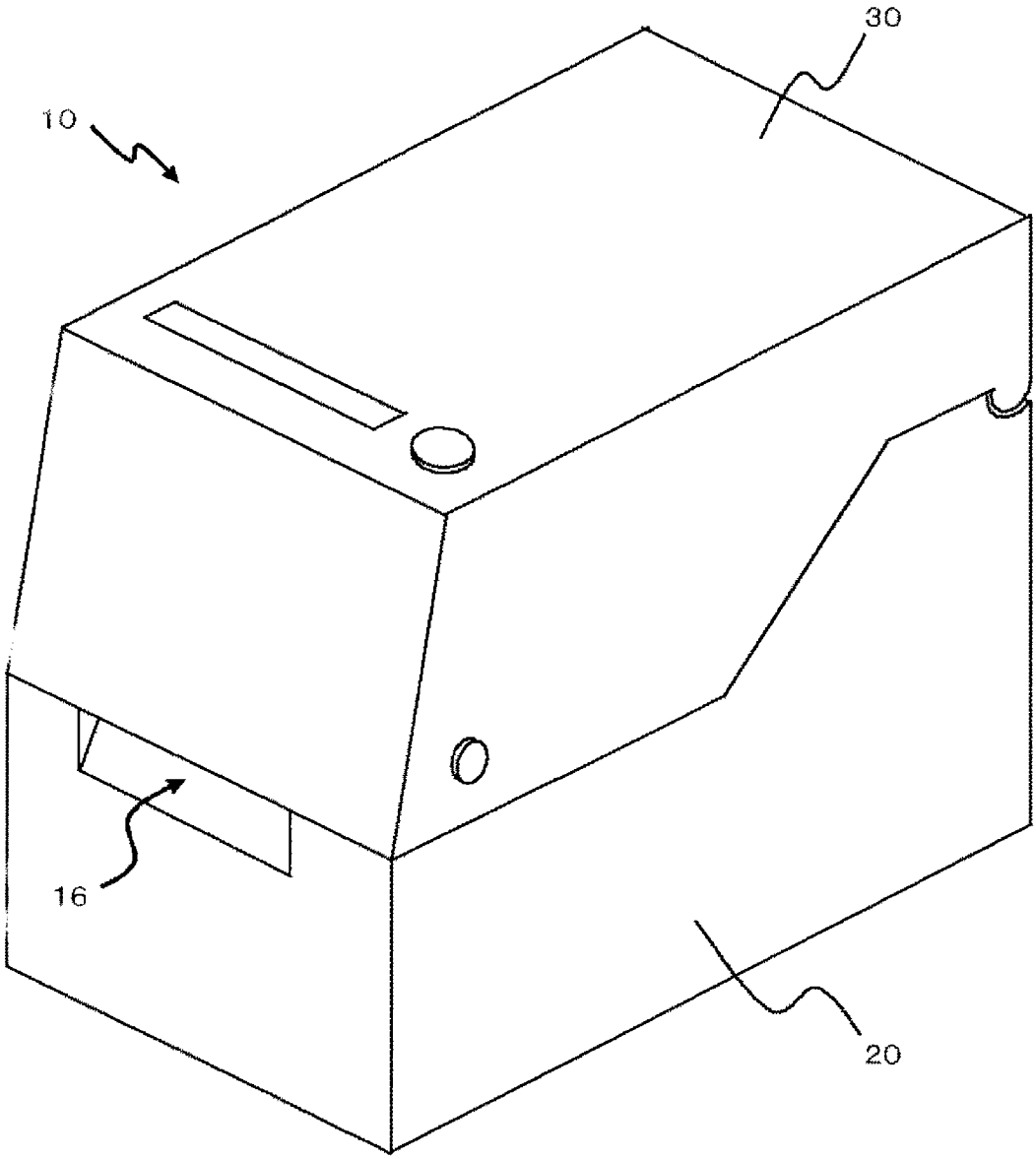
FIG. 2 is an external perspective view showing the thermal printer according to this embodiment of the present invention in a closed state.

FIG. 2 shows the thermal printer 10 in a closed state, i.e. when the upper lid portion 30 is closed. In the closed state, the printing unit 40 is positioned between the main body 20 and the upper lid portion 30, and as shown in FIG. 1, the thermal head 12 provided in the printing unit 40 is positioned so as to be pressed against the platen roller 11 provided in the main body. Note that the printing unit 40 is fitted to the upper lid portion 30 detachably, and in the closed state shown in FIG. 2, the printing unit 40 is shown in a fitted state, i.e. fitted to the upper lid portion 30.

Figure 3:
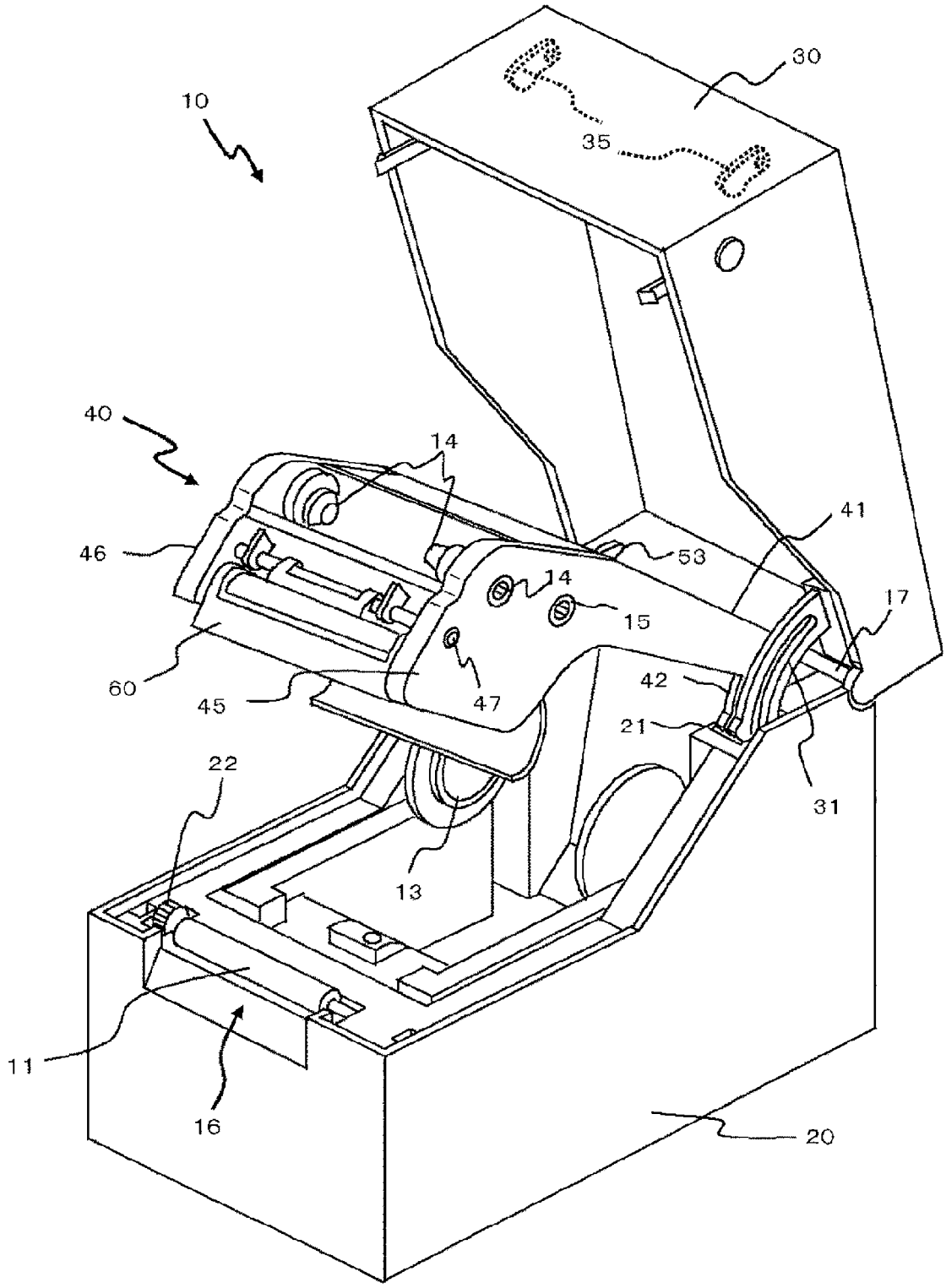
FIG. 3 is an external perspective view showing the thermal printer according to this embodiment of the present invention in a ribbon replacement state.
Figure 4:
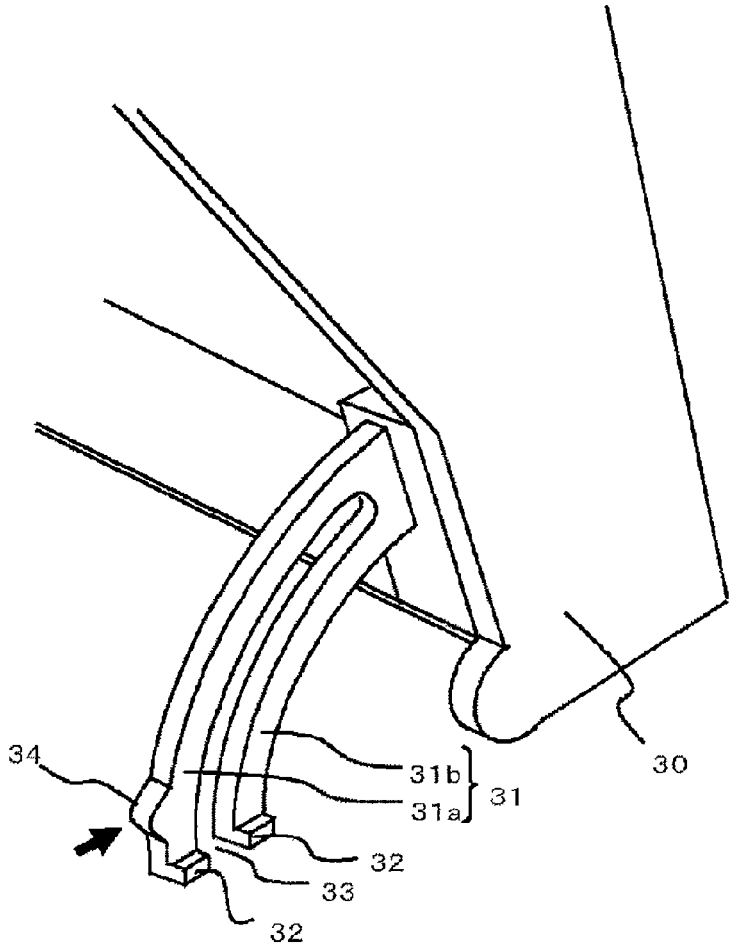
FIG. 4 is a schematic perspective view showing the constitution of an upper lid portion guide plate and a printing unit guide plate shown in FIG. 3.
Figure 4:
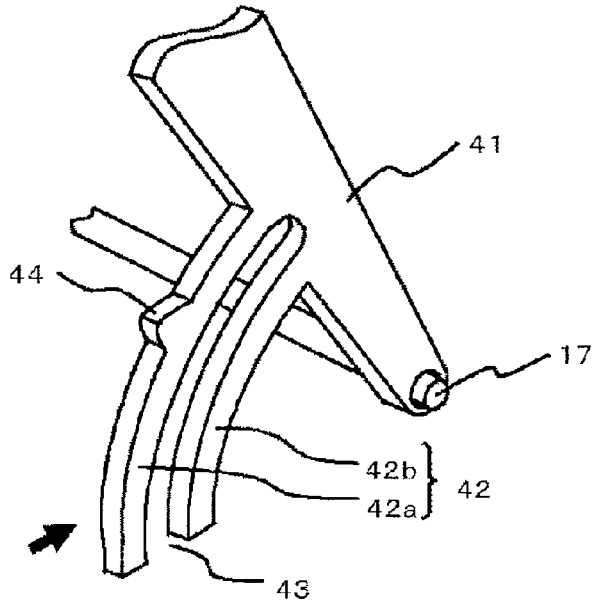

FIG. 3 shows the thermal printer 10 in a ribbon replacement state in which the printing unit 40 and the upper lid portion 30 are supported independently with the printing unit 40 supported at a smaller angle than the upper lid portion 30, or in other words such that a working space is secured above and below the printing unit 40. The upper lid portion 30 is opened and closed while being guided by an upper lid portion guide plate 31 having a function for supporting the upper lid portion 30 in the ribbon replacement state shown in FIG. 3. Referring to FIG. 4A, the upper lid portion guide plate 31 is an arc-shaped member centering on the support shaft 17, one end portion of which is fixed to the upper lid portion 30 and an open end side of which is inserted into an opening 21 formed in the main body 20. A collar portion 32 that limits an opening angle of the upper lid portion 30 by contacting a rear surface side of an edge portion of the opening 21 is formed on a tip end portion of the open end side.

The upper lid portion guide plate 31 is divided into a first piece 31*a* and a second piece 31*b* by a slit 33 formed at a constant width from the open end side toward the one end portion side fixed to the upper lid portion 30, and the first piece 31*a* is capable of deforming elastically toward an inner side, or in other words in the direction of the second piece 31*b* on the opposite side of the slit 33. Further, an upper lid portion stopper 34 is formed as a projection on an outer side of the first piece 31*a*, or in other words on an opposite surface to the surface of the first piece 31*a* that opposes the second piece 31*b* via the slit 33. Hence, when the upper lid portion 30 is opened relative to the main body 20 by a predetermined angle or more, the upper lid portion stopper 34 is withdrawn from the opening 21 so as to contact a front surface side of the edge portion of the opening 21 elastically, and as a result, the upper lid portion 30 can be supported at a predetermined angle relative to the main body 20 in the ribbon replacement state shown in FIG. 3. When a closing direction force is applied to the upper lid portion 30, the first piece 31*a* is pressed from the edge portion of the opening 21 so as to deform inwardly, whereby the contact between the upper lid portion stopper 34 and the edge portion of the opening 21 is released.

Meanwhile, in the printing unit 40, as shown in FIG. 3, a right ribbon frame 45 and a left ribbon frame 46 on which the ribbon winding shaft 14 and the ribbon supply shaft 15, respectively, are suspended rotatably are provided on respective open end sides of an arm portion 41, one end of which is supported by the support shaft 17, to be capable of rotating independently of the upper lid portion 30. Note that the upper lid portion 30 is provided with a connecting member 35 that maintains the printing unit 40 in a fitted state by contacting the printing unit 40 elastically, or in other words connects the upper lid portion 30 and the printing unit 40 in the fitted state. In the closed state shown in FIG. 2, or in other words when the upper lid portion 30 and the printing unit 40 are closed, the printing unit 40 is in the fitted state, i.e. fitted to the upper lid portion 30, and the upper lid portion 30 and printing unit 40 are connected by the connecting member 35. When the upper lid portion 30 is opened from the closed state shown in FIG. 2, the upper lid portion 30 and the printing unit 40 remain connected such that the printing unit 40 rotates together with the upper lid portion 30 in the fitted state. When the printing unit 40 is then withdrawn from the upper lid portion 30, the withdrawn printing unit 40 is supported at a smaller angle than the upper lid portion 30 by a printing unit guide plate 42. In other words, the printing unit 40 and the upper lid portion 30 are supported independently in the ribbon replacement state such that a working space is secured above and below the printing unit 40.

Referring to FIG. 4B, the printing unit guide plate 42 is an arc-shaped member centering on the support shaft 17, one end portion of which is fixed to the arm portion 41 and an open end side of which is inserted into the opening 21 formed in the main body 20. The printing unit guide plate 42 is divided into a first piece 42*a* and a second piece 42*b* by a slit 43 formed at a constant width from the open end side toward the one end portion side fixed to the arm portion 41, and the first piece 42*a* is capable of deforming elastically toward an inner side, or in other words in the direction of the second piece 42*b* on the opposite side of the slit 43. Further, a unit stopper 44 is formed as a projection on an outer side of the first piece 42*a*, or in other words on an opposite surface to the surface of the first piece 42*a* that opposes the second piece 42*b* via the slit 43. Hence, when the unit stopper 44 contacts the front surface side of the edge portion of the opening 21 elastically, the printing unit 40 is supported relative to the main body 20 by the unit stopper 44 of the printing unit guide plate 42 at a smaller angle than the angle by which the upper lid portion 30 is supported relative to the main body 20. In other words, as shown in FIG. 3, the printing unit 40 is withdrawn from the upper lid portion 30 so as to be independent thereof, and supported relative to the main body 20 such that a working space is secured above and below the printing unit 40. Furthermore, when a closing direction force is applied to the printing unit 40, the first piece 42*a* is pressed from the edge portion of the opening 21 so as to deform inwardly, whereby the contact between the unit stopper 44 and the edge portion of the opening 21 is released. Note that in FIG. 4B, the open end side of the printing unit guide plate 42 is partitioned into the first piece 42*a* and the second piece 42*b*, but as long as the part of the first piece 42*a* formed with the unit stopper 44 is capable of deforming inwardly such that contact with the edge portion of the opening 21 is released, the first piece 42*a* and second piece 42*b* may be formed continuously on the open end side.

Figure 5:
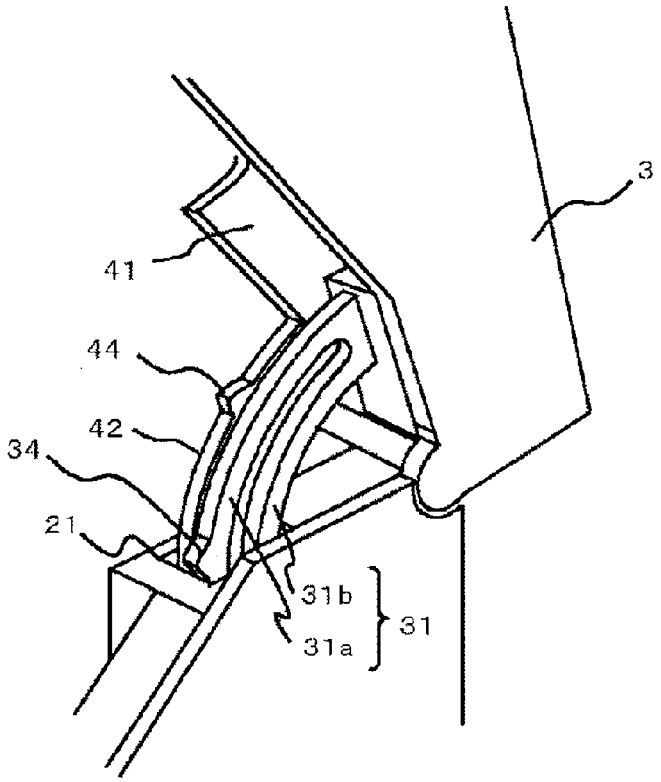
FIG. 5 is an illustrative view illustrating an operation of the upper lid portion guide plate and the printing unit guide plate shown in FIG. 3.
Figure 5:
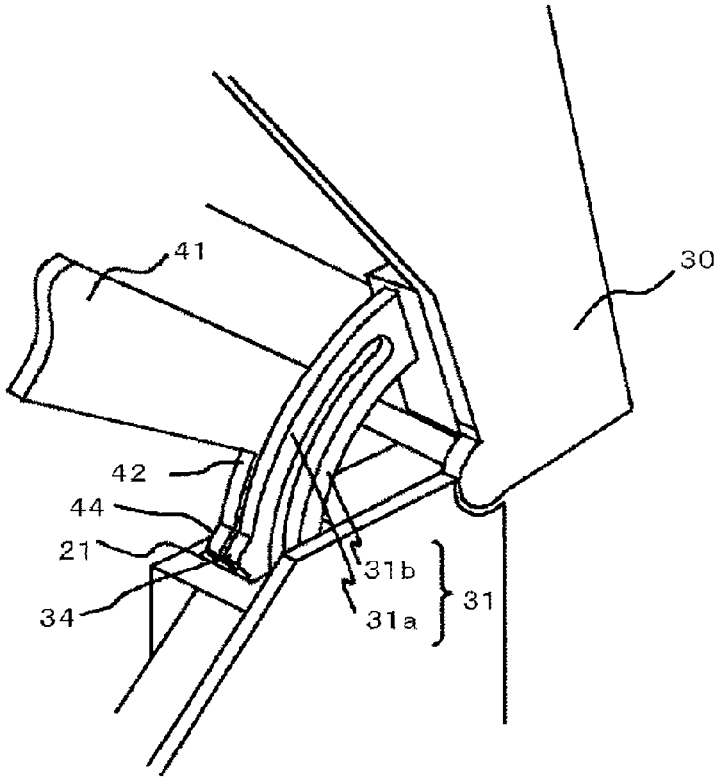

FIG. 5A shows a sheet replacement state in which the upper lid portion 30 is supported in the fitted state, i.e. a state in which the upper lid portion stopper 34 is withdrawn from the opening 21 so as to contact the front surface side of the edge portion of the opening 21 elastically and the printing unit 40 remains fitted to the upper lid portion 30, and a part above the supply portion 13 is open so that the roll sheet 3 can be replaced. In this state, the unit stopper 44 does not contact the front surface side of the edge portion of the opening 21 but the printing unit 40 is maintained in the fitted state, i.e. fitted to the upper lid portion 30, by the connecting member 35. In other words, the upper lid portion 30 and the printing unit 40 are connected.

In FIG. 5B, the upper lid portion 30 is supported by the upper lid portion stopper 34, which is withdrawn from the opening 21 so as to contact the front surface side of the edge portion of the opening 21 elastically, and the printing unit 40 is supported at a smaller angle than the upper lid portion 30 by the unit stopper 44 contacting the front surface side of the edge portion of the opening 21 elastically. Thus, the printing unit 40 is supported independently of the upper lid portion 30 in the ribbon replacement state such that a working space is secured above and below the printing unit 40.

Figure 6:
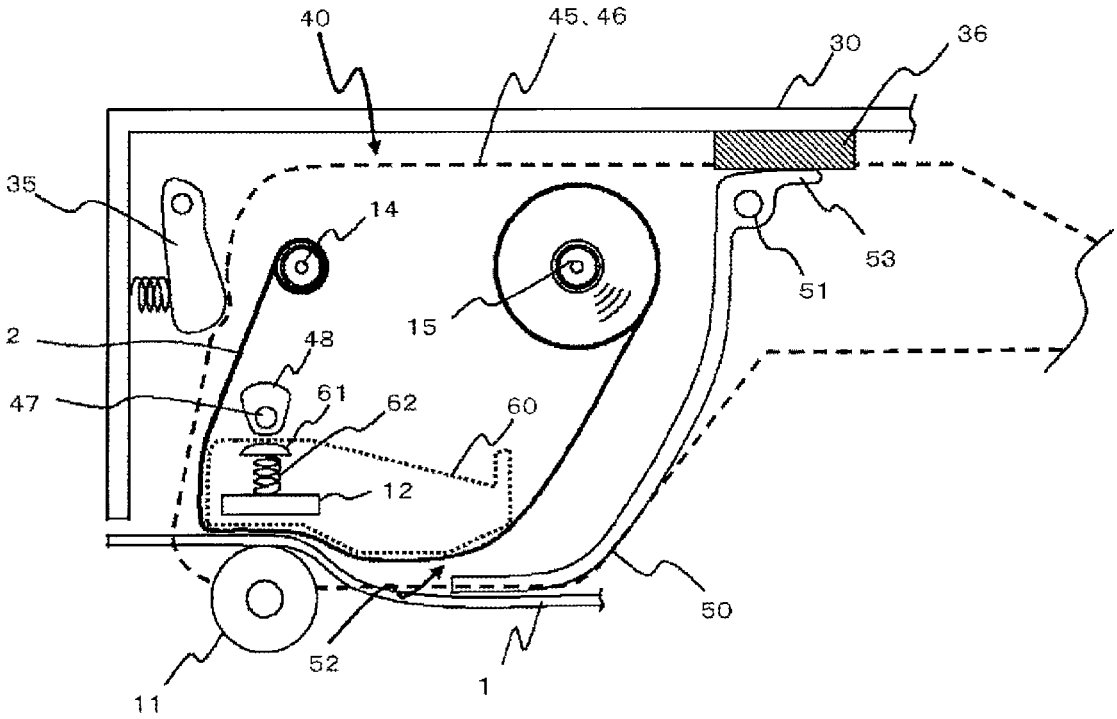
FIG. 6 is a schematic side view showing the constitution of a printing unit in the closed state shown in FIG. 2.

Referring to FIG. 6, the printing unit 40 also includes head pressure adjusting means constituted by an adjustment shaft 47 suspended between the right ribbon frame 45 and left ribbon frame 46 in a perpendicular direction thereto, and an eccentric member 48 attached to the adjustment shaft 47. Through holes for operating the ribbon winding shaft 14, the ribbon supply shaft 15, and the adjustment shaft 47 are formed in the right ribbon frame 45 in locations corresponding respectively to the ribbon winding shaft 14, the ribbon supply shaft 15, and the adjustment shaft 47. The left ribbon frame 46 is provided with a transmitted gear, not shown in the drawings, that meshes in the closed state shown in FIG. 2 with a transmission gear 22 driven to rotate together with the platen roller 11, and a driving force transmission mechanism such as a gear or a belt, not shown in the drawings, for transmitting a rotary driving force from the transmitted gear to the ribbon winding shaft 14.

A head housing 60 is incorporated below the ribbon winding shaft 14 and ribbon supply shaft 15 and has a lower surface that functions as a guide surface for guiding the ink ribbon 2 supplied between the platen roller 11 and the thermal head 12 from the ribbon supply shaft 15. Further, the head housing 60 is provided pivotably on a rotary shaft, not shown in the drawings, which is provided further upstream in a conveyance direction of the printing medium 1 than the (heat generators formed on the) thermal head 12, to be capable of moving in a substantially perpendicular direction to the printing surface of the thermal head 12. The thermal head 12 is fixed to the head housing 60, and a pressing member 61 that contacts the head pressure adjusting means, to be described below, when the head housing 60 is incorporated into the printing unit 40 is supported on an opposite surface side to the printing surface of the thermal head 12 to be capable of moving in a perpendicular direction to the printing surface. Further, a spring 62 is interposed between the thermal head 12 and the pressing member 61. Thus, the thermal head 12 fixed to the head housing 60 is pressed against the platen roller 11 by a biasing force of the spring 62.

The head pressure adjusting means constituted by the adjustment shaft 47 and the eccentric member 48 is provided above the incorporated head housing 60, or in other words on the pressing member 61 side. By rotating the adjustment shaft 47 such that the eccentric member 48 contacts the pressing member 61, a position of the pressing member 61 within the head housing 60 is controlled, whereby a force for pressing the thermal head 12 against the platen roller 11, or in other words a head pressure, can be adjusted.

The printing unit 40 is further provided with a ribbon cover 50 covering a part below the ribbon supply shaft 15. The ribbon cover 50 is disposed further toward a rear side than the ribbon supply shaft 15, or in other words on the arm portion 41 side, and is supported to be free to rotate by a rotary shaft 51 provided perpendicular to the right ribbon frame 45 and left ribbon frame 46.

Referring to FIG. 6, the ribbon cover 50 is formed such that when a contact member 36 provided in the upper lid portion 30 contacts a contacted end 53 of the ribbon cover 50 on the opposite side of the rotary shaft 51 in the closed state in which the upper lid portion 30 is closed, i.e. the fitted state in which the printing unit 40 is fitted to the upper lid portion 30, the ribbon cover 50 enters a closed state. In this closed state, a gap between a lower surface of the head housing 60 and an upper surface of the ribbon cover 50 forms an insertion passage 52 into which the ink ribbon 2 supplied from the ribbon supply shaft 15 to the thermal head 12 is inserted, and a lower surface of the ribbon cover 50 functions as a guide plate for guiding the printing medium 1, which is supplied to the thermal head 12 from the supply portion 13, from an upper side.

Figure 7:
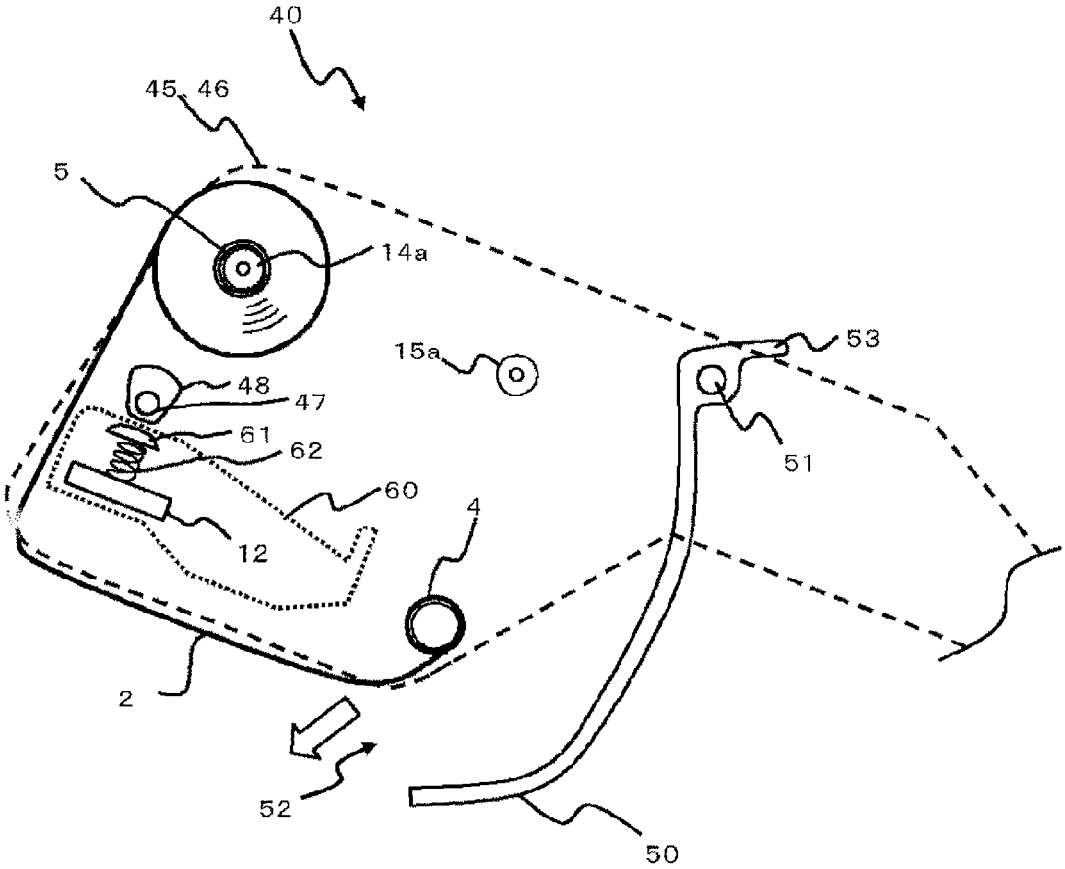
FIG. 7 is a schematic side view showing the constitution of the printing unit in the ribbon replacement state shown in FIG. 3.

As shown in FIG. 3, in the ribbon replacement state in which the upper lid portion 30 and the printing unit 40 are rotated independently, the contact between the contacted end 53 and the contact member 36 provided on the upper lid portion 30 and the contact between the ribbon cover 50 and the main body 20 are released, and therefore the ribbon cover 50 rotates under its own weight in a direction heading away from the lower surface of the head housing 60, causing the insertion passage 52 to widen greatly, as shown in FIG. 7.

Next, an attachment operation for attaching the ink ribbon 2 to the printing unit 40 according to this embodiment will be described in detail with reference to FIGS. 8 and 9.

Figure 8:
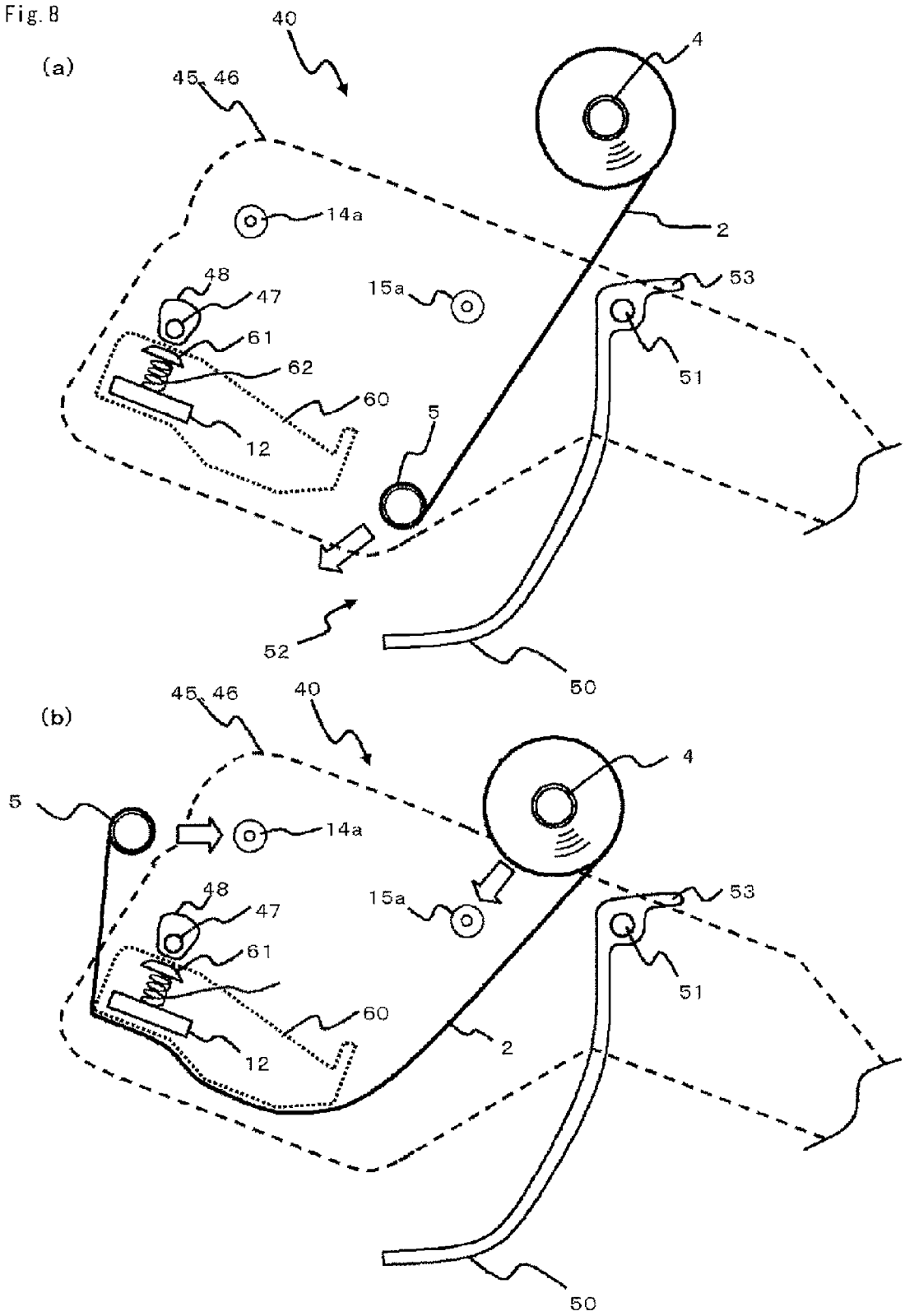
FIG. 8 is an illustrative view illustrating an operation for attaching an ink ribbon to the printing unit in the thermal printer according to this embodiment of the present invention.
Figure 9:
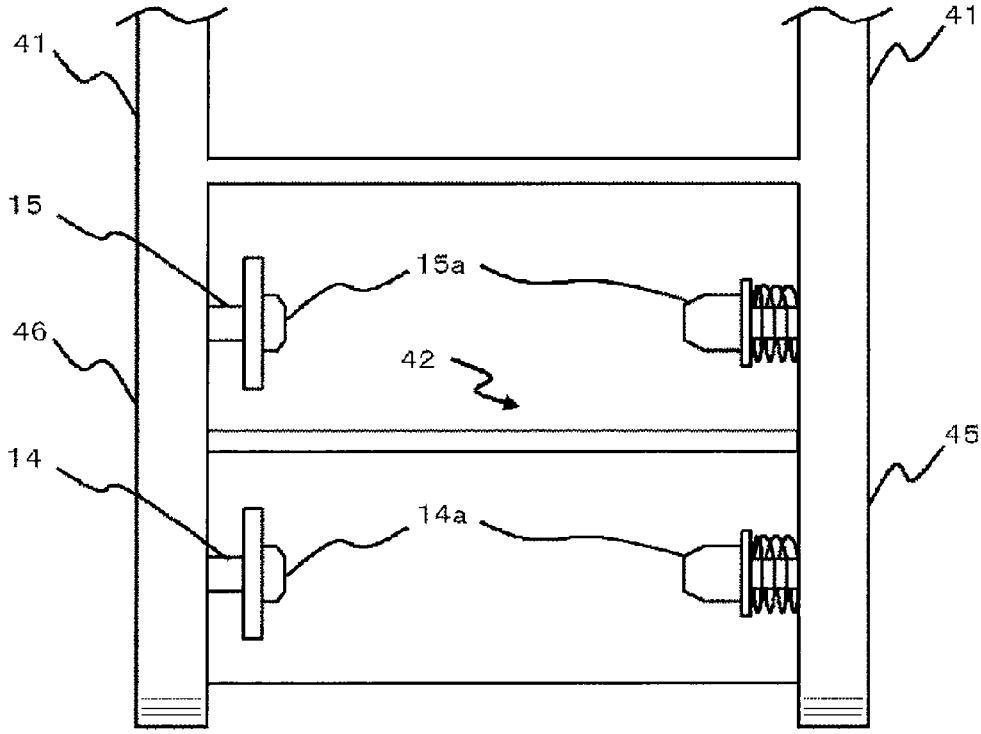
FIG. 9 is a plan view showing the printing unit shown in FIG. 3 from an upper side.
Figure 9:
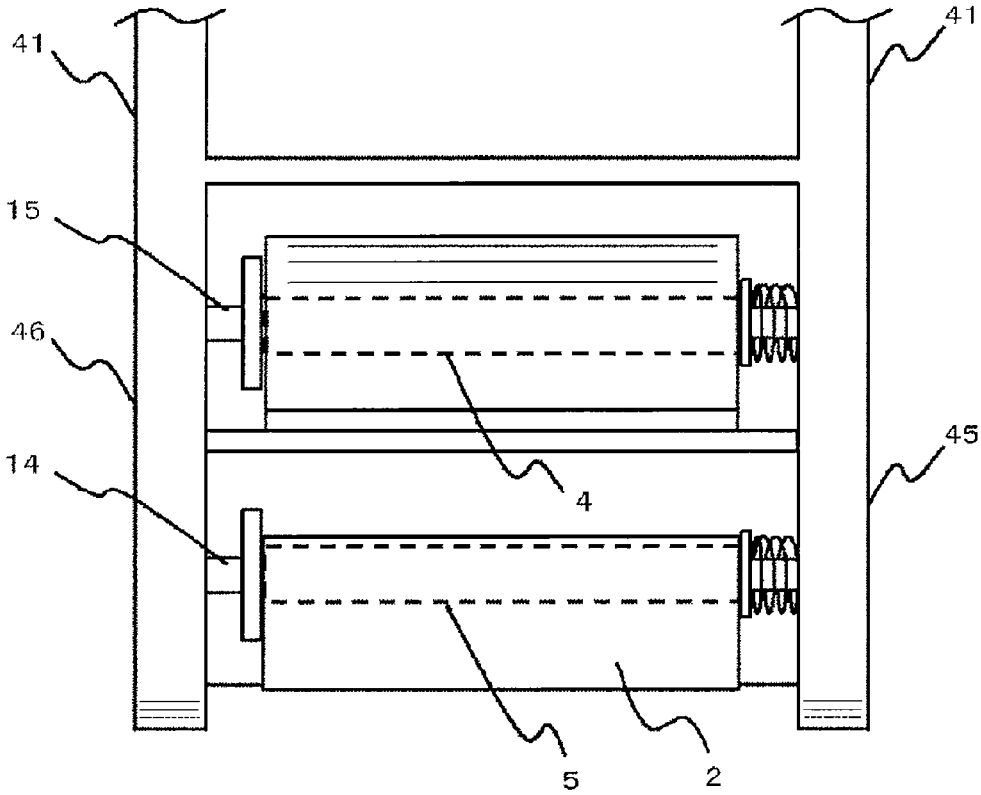

FIG. 8 is an illustrative view illustrating an operation for attaching the ink ribbon to the printing unit in the thermal printer according to this embodiment of the present invention. FIG. 9 is a plan view showing the printing unit shown in FIG. 3 from an upper side.

To replace the roll sheet 3 or the ink ribbon 2, first, the upper lid portion 30 is opened from the closed state shown in FIG. 2 until it is supported by the upper lid portion stopper 34, whereby as shown in FIG. 6, a paper replacement state is established in which the upper lid portion 30 is supported in the fitted state where the printing unit 40 is fitted to the upper lid portion 30 while the printing unit 40 remains fitted thereto by the connecting member 35, i.e. the upper lid portion 30 and the printing unit 40 are connected and the printing unit 40 rotates together with the upper lid portion 30. In this state, the upper part of the supply portion 13 (the main body 20) is open, and therefore an operation to replace the roll sheet 3 can be performed. Note that in this embodiment, the connecting member 35 contacts the printing unit 40 elastically by means of a spring, but the connecting member 35 may itself be constituted by an elastic material such as rubber. Further, the connecting member 35 is provided in the upper lid portion 30, but the connecting member 35 may be provided in the printing unit 40 such that the upper lid portion 30 and the printing unit 40 are connected when the printing unit 40 contacts the upper lid portion 30 elastically.

Next, the fitted printing unit 40 is withdrawn from the upper lid portion 30 such that the contact between the connecting member 35 and the upper lid portion 30, or in other words the connection formed between the upper lid portion 30 and the printing unit 40 by the connecting member 35, is released. As a result, it becomes possible to move the printing unit 40 in the closing direction, and therefore the printing unit 40 is moved in the closing direction until the unit stopper 44 contacts the front surface side of the edge portion of the opening 21. Accordingly, the unit stopper 44 contacts the front surface side of the edge portion of the opening 21 elastically, whereby the printing unit 40 is supported by the unit stopper 44 of the printing unit guide plate 42 at a smaller angle than the angle at which the upper lid portion 30 is supported. In other words, the ribbon replacement state shown in FIG. 3, in which the printing unit 40 is withdrawn from the upper lid portion 30 and supported independently of the upper lid portion 30 such that a working space is secured above and below the printing unit 40, is established.

In the ribbon replacement state, the ribbon cover 50 is rotated in the direction heading away from the lower surface of the head housing 60, causing the insertion passage 52, or in other words the gap between the lower surface of the head housing 60 and the upper surface of the ribbon cover 50, to widen until it becomes at least larger than a diameter of a supply spool shaft 4 and a winding spool shaft 5. The supply spool shaft 4, from which the ink ribbon 2 is unreeled prior to use, is then removed from a supply spool shaft attachment portion 15*a* and passed through the widened insertion passage 52, as shown by an arrow in FIG. 7, whereupon the winding spool shaft 5, around which the ink ribbon 2 is wound following use, is removed from a winding spool shaft attachment portion 14*a*.

As shown in FIG. 8A, the ink ribbon 2 is supplied while suspended between the supply spool shaft 4, which is constituted by a tubular body such as a paper tube on which the unused ink ribbon 2 is wound, and the winding spool shaft 5, which is constituted by a tubular body such as a paper tube on which the post-transfer ink ribbon 2 is wound. Referring to FIG. 9A, the winding spool shaft attachment portion 14*a*, which sandwiches the winding spool shaft 5 from an axial direction, and the supply spool shaft attachment portion 15*a*, which sandwiches the supply spool shaft 4 from the axial direction, are provided on the ribbon winding shaft 14 and the ribbon supply shaft 15, respectively, and as shown in FIG. 9B, the winding spool shaft 5 is attached to the winding spool shaft attachment portion 14*a* as the ribbon winding shaft 14 while the supply spool shaft 4 is attached to the supply spool shaft attachment portion 15*a* as the ribbon supply shaft 15.

Next, a new ink ribbon 2 wound onto the supply spool shaft 4 is prepared, and the winding spool shaft 5 is passed through the widened insertion passage 52, as shown by an arrow in FIG. 8A. As shown by an arrow in FIG. 8B, the winding spool shaft 5 and the supply spool shaft 4 are then attached to the winding spool shaft attachment portion 14*a* and the supply spool shaft attachment portion 15*a* as the ribbon winding shaft 14 and the ribbon supply shaft 15, respectively, such that the ink ribbon 2 passes the printing surface of the thermal head 12, whereupon the ribbon winding shaft 14 and ribbon supply shaft 15 are rotated to eliminate slackness in the ink ribbon 2.

Note that when the ink ribbon 2 is removed or attached in the ribbon replacement state, force may be applied in a direction for closing the printing unit 40, but in this embodiment, even when force is applied in a direction for closing the printing unit 40, thereby releasing the contact between the unit stopper 44 and the edge portion of the opening 21 such that the printing unit 40 closes, the upper lid portion 30 remains supported by the upper lid portion stopper 34, and therefore hands do not become wedged between the upper lid portion 30 and the printing unit 40.

Further, when a defect such as a crease, a variation in a printing color, and so on occur in the ink ribbon 2 during use, a replacement operation may be performed in a state where the unused ink ribbon 2 is wound around the supply spool shaft 4 and the post-transfer ink ribbon 2 is wound around the winding spool shaft 5, and in this case, the supply spool shaft 4 wound with the unused ink ribbon 2 or the winding spool shaft 5 wound with the post-transfer ink ribbon 2 must be passed through the widened insertion passage 52. Therefore, in the ribbon replacement state, the insertion passage 52, or in other words the gap between the lower surface of the head housing 60 and the upper surface of the ribbon cover 50, is preferably set to be at least wider than a wound diameter of the supply spool shaft 4 and the winding spool shaft 5 when half of the ink ribbon 2 has been used so that the supply spool shaft 4 and the winding spool shaft 5 can be passed through the insertion passage 52 in a state where half of the ink ribbon 2 has been used.

Next, the printing unit 40 and the upper lid portion 30 are closed such that the closed state shown in FIG. 2 is established. Since the printing unit 40 and the upper lid portion 30 are supported individually by the unit stopper 44 and the upper lid portion stopper 34 contacting the front surface side of the edge portion of the opening 21 elastically, the first piece 42*a* of the printing unit guide plate 42 is pressed from the edge portion of the opening 21 when a closing direction force is exerted on the printing unit 40, thereby deforming such that the contact between the edge portion of the opening 21 and the unit stopper 44 is released, and the first piece 31*a* of the upper lid portion guide plate 31 is pressed from the edge portion of the opening 21 when a closing direction force is exerted on the upper lid portion 30, thereby deforming such that the contact between the edge portion of the opening 21 and the upper lid portion stopper 34 is released. Accordingly, a procedure for closing the printing unit 40 and the upper lid portion 30 to establish the closed state shown in FIG. 2 may be performed as desired. More specifically, the upper lid portion 30 may be closed after closing the printing unit 40, or a closing direction force may be exerted on the printing unit 40 by closing the upper lid portion 30 such that the upper lid portion 30 and the printing unit 40 are closed together.

When the closed state shown in FIG. 2 is established, the printing unit 40 is in the fitted state, i.e. fitted to the upper lid portion 30, and as shown in FIG. 6, the contact member 36 provided in the upper lid portion 30 contacts the contacted end 53 of the ribbon cover 50 on the opposite side of the rotary shaft 51 such that the ribbon cover 50 is closed. Hence, the gap between the lower surface of the head housing 60 and the upper surface of the ribbon cover 50 forms the insertion passage 52 for the ink ribbon 2 supplied to the thermal head 12 from the ribbon supply shaft 15, and the lower surface of the ribbon cover 50 functions as the guide plate for guiding the printing medium 1 supplied to the thermal head 12 from the supply portion 13 from the upper side. Note that when the printing unit 40 is lowered onto the main body 20 without being fitted to the upper lid portion 30, the ribbon cover 50 likewise contacts the main body 20, and therefore the ribbon cover 50 is closed.

Figure 10:
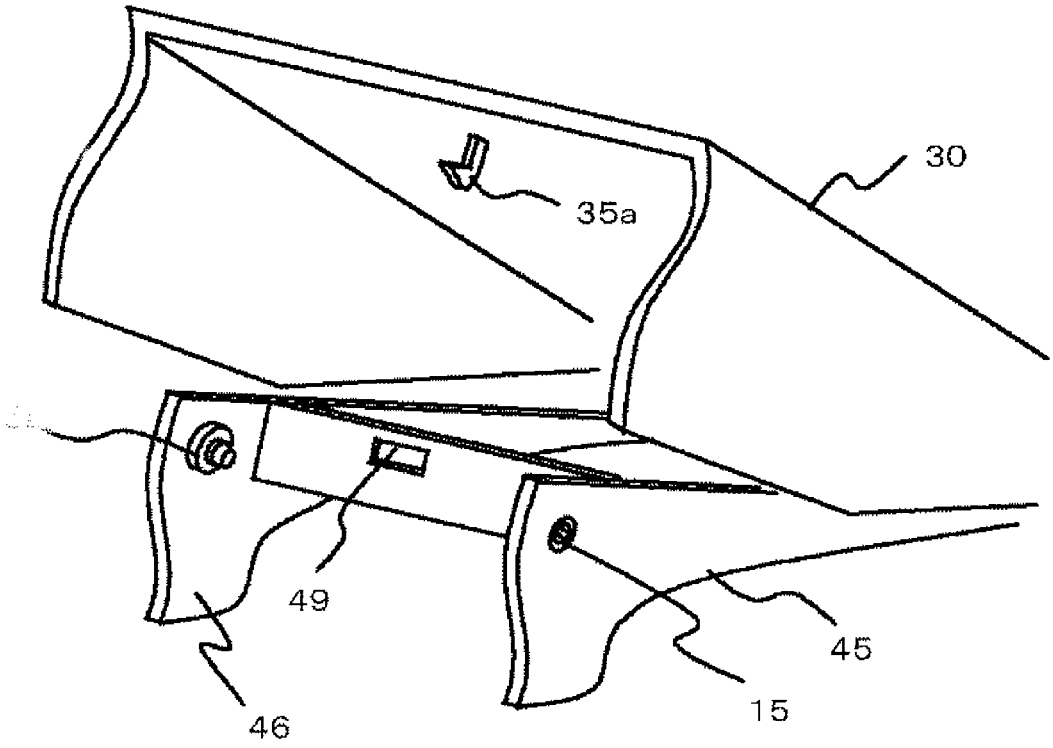
FIG. 10 is a schematic perspective view showing the constitution of a connecting member shown in FIG. 6 according to another embodiment.

FIG. 10 is a schematic perspective view showing the constitution of the connecting member 35 shown in FIG. 6 according to another embodiment.

In this embodiment, the printing unit 40 and the upper lid portion 30 are connected in the fitted state by having the connecting member 35 contact the printing unit 40 elastically. As shown in FIG. 10, however, a hook 35*a* formed from a flexible material such as resin may be provided in the upper lid portion 30 as the connecting member 35 and a latched portion 49 that is latched by the hook 35*a* in the fitted state, i.e. when the printing unit 40 is fitted to the upper lid portion 30, may be provided in the printing unit 40 such that in the fitted state where the printing unit 40 is fitted to the upper lid portion 30, the latched portion 49 provided in the printing unit 40 is latched by the hook 35*a* provided in the upper lid portion 30, thereby connecting the upper lid portion 30 and the printing unit 40, and when the printing unit 40 in the fitted state is withdrawn from the upper lid portion 30, the hook 35*a* deforms such that the latch between the hook 35*a* and the latched portion 49 is released, or in other words the connection between the upper lid portion 30 and the printing unit 40 is released. Note that the shapes and disposal locations of the hook 35*a* and the latched portion 49 may be set as desired. Moreover, the hook 35*a* may be provided in the printing unit 40 and the latched portion 49 may be provided in the upper lid portion 30.

As described above, this embodiment is provided with the upper lid portion stopper 34 (upper lid portion guide plate 31) that supports the upper lid portion 30 in a predetermined position relative to the main body 20 and releases support of the upper lid portion 30 when a closing direction force is exerted on the upper lid portion 30, the unit stopper 44 (printing unit guide plate 42) that supports the printing unit 40 at a smaller angle than the upper lid portion 30 relative to the main body 20 and releases support of the printing unit 40 when a closing direction force is exerted on the printing unit 40, and the connecting member 35 that connects the upper lid portion 30 and the printing unit 40 in the fitted state where the printing unit 40 is fitted to the upper lid portion 30, and in a state where the upper lid portion 30 and the printing unit 40 are closed, the upper lid portion 30 and printing unit 40 are connected by the connecting member 35 so that simply by opening the upper lid portion 30, the printing unit 40 fitted to the upper lid portion 30 can be opened at the same time. Hence, the upper lid portion 30 and the printing unit 40 can be opened relative to the main body 20 by a single operation, and since the support provided to the printing unit 40 by the unit stopper 44 is released when a closing direction force is exerted on the printing unit 40, the upper lid portion 30 and printing unit 40 can be closed relative to the main body 20 by a single operation of closing the upper lid portion 30 from the ribbon replacement state in which the printing unit 40 is supported independently of and at a smaller angle than the upper lid portion 30.

Furthermore, according to this embodiment, when the printing unit 40 is withdrawn from the upper lid portion 30 in a state where the upper lid portion 30 and the printing unit 40 are open, the connection established between the upper lid portion 30 and the printing unit 40 by the connecting member 35 is released, and it is therefore possible to establish a state in which the printing unit 40 is supported by the unit stopper 44 (printing unit guide plate 42) through a simple operation of withdrawing the printing unit 40 from the upper lid portion 30.

Figure 11:
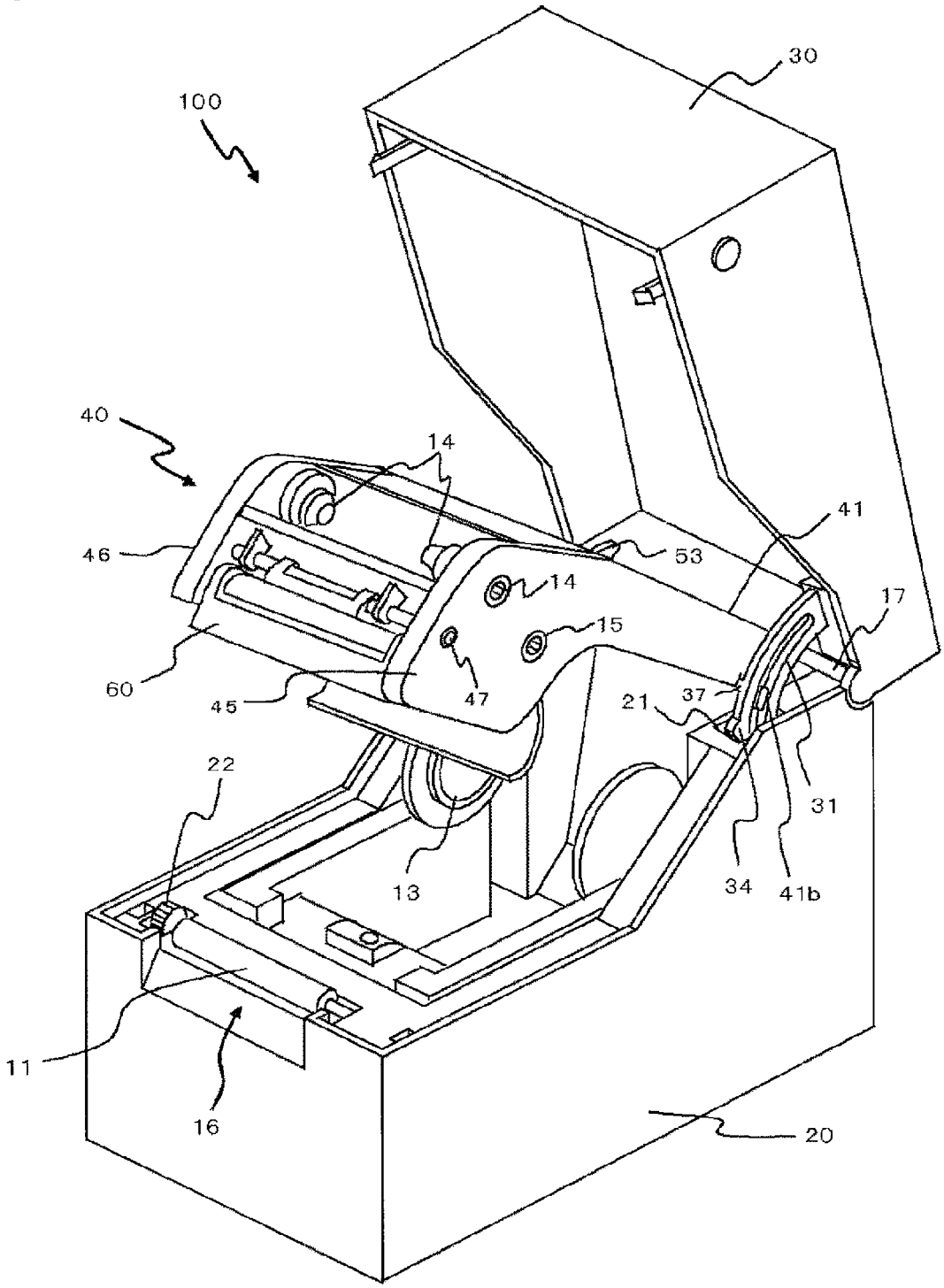
FIG. 11 is an external perspective view showing a thermal printer according to another embodiment in an open state.
Figure 12:
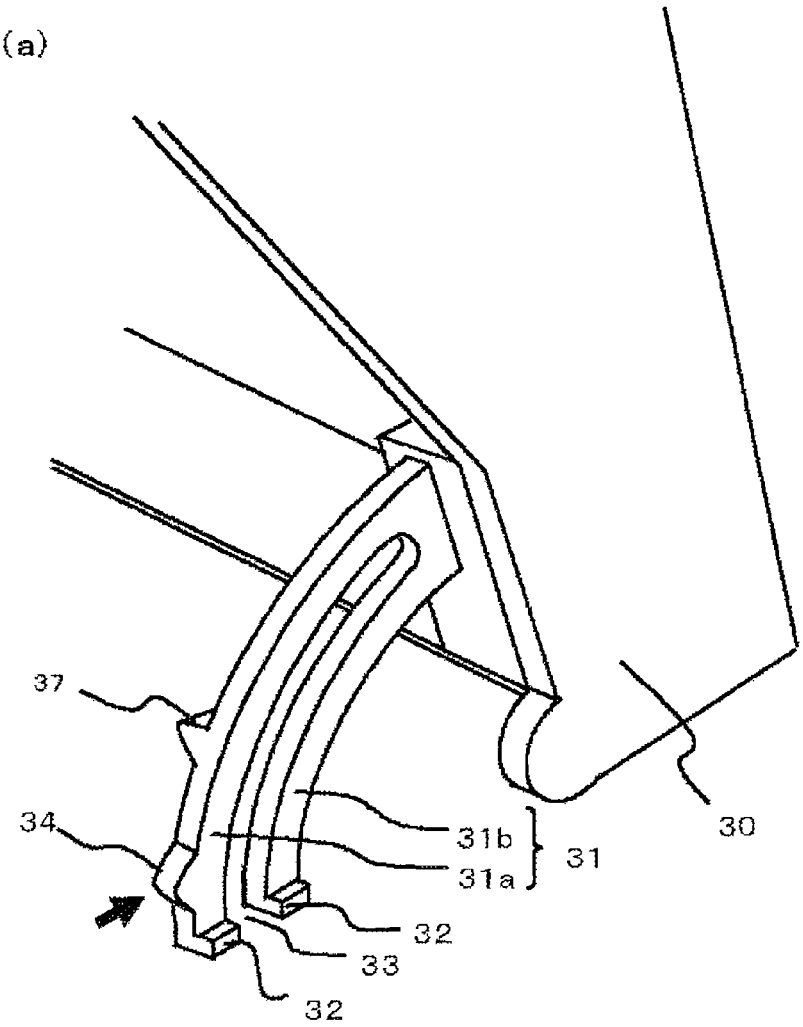
FIG. 12 is a schematic perspective view showing the constitution of a guide plate and an arm portion shown in FIG. 11.
Figure 12:
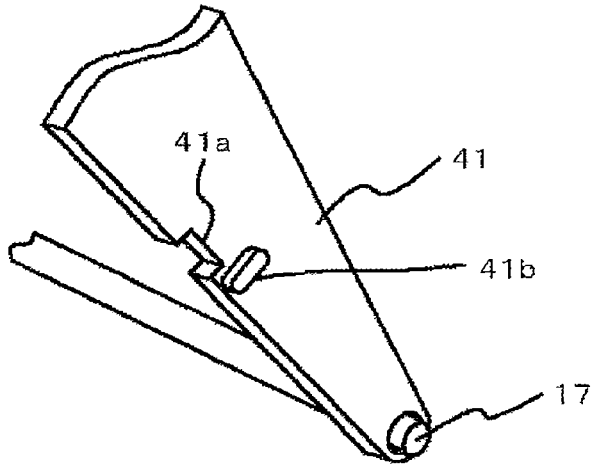
Figure 13:
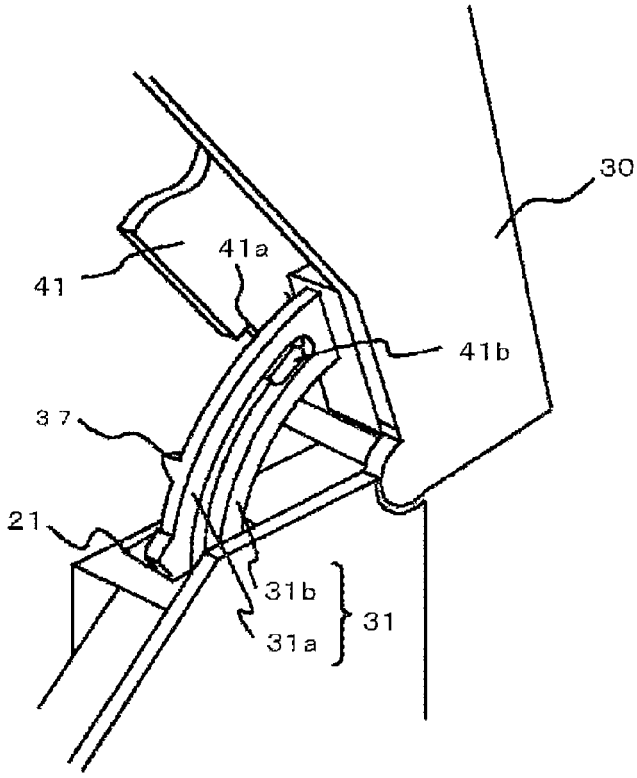
FIG. 13 is an illustrative view illustrating an operation of the guide plate shown in FIG. 11.
Figure 13:
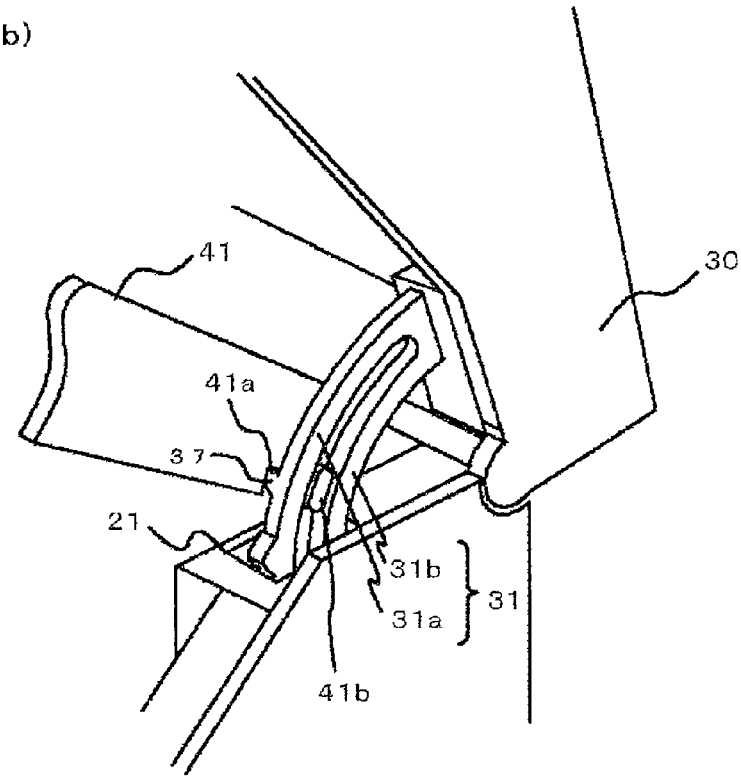

Next, a thermal printer according to another embodiment will be described. FIG. 11 is an external perspective view showing a thermal printer according to another embodiment of the present invention in an open state. FIG. 12 is a schematic perspective view showing the constitution of a guide plate and an arm portion shown in FIG. 11. FIG. 13 is an illustrative view illustrating an operation of the guide plate shown in FIG. 11. Note that identical constitutions to those described above have been allocated identical reference symbols and both description and illustration thereof have been omitted.

FIG. 11 shows a thermal printer 100 in an open state, i.e. when the upper lid portion 30 is open. The upper lid portion 30 is opened and closed while being guided by the upper lid portion guide plate 31 having a function for supporting the upper lid portion 30 in the open state shown in FIG. 11. Referring to FIG. 12A, the upper lid portion guide plate 31 is an arc-shaped member centering on the support shaft 17, one end portion of which is fixed to the upper lid portion 30 and the open end side of which is inserted into the opening 21 formed in the main body 20. The collar portion 32 that limits the opening angle of the upper lid portion 30 by contacting the rear surface side of the edge portion of the opening 21 is formed on the tip end portion on the open end side.

The upper lid portion guide plate 31 is divided into the first piece 31*a* and the second piece 31*b* by the slit 33 formed at a constant width from the open end side toward the one end portion side fixed to the upper lid portion 30, and the first piece 31*a* is capable of deforming elastically toward the inner side, or in other words in the direction of the second piece 31*b* on the opposite side of the slit 33. Further, the upper lid portion stopper 34 is formed as a projection on the outer side of the first piece 31*a*, or in other words on the opposite surface to the surface of the first piece 31*a* that opposes the second piece 31*b* via the slit 33. Hence, when the upper lid portion 30 is opened by a predetermined angle or more, the upper lid portion stopper 34 is withdrawn from the opening 21 so as to contact the front surface side of the edge portion of the opening 21 elastically, and as a result, the upper lid portion 30 can be supported in the open state shown in FIG. 11.

Meanwhile, in the printing unit 40, as shown in FIG. 11, the right ribbon frame 45 and the left ribbon frame 46 on which the ribbon winding shaft 14 and the ribbon supply shaft 15, respectively, are suspended rotatably are provided on respective open end sides of the arm portion 41, one end of which is supported by the support shaft 17, to be capable of rotating independently of the upper lid portion 30. Note that the upper lid portion 30 is provided with a contact member, not shown in the drawings, that maintains the printing unit 40 in the fitted state by contacting the printing unit 40 elastically, and therefore, when the upper lid portion 30 is opened from the closed state, the printing unit 40 rotates together with the upper lid portion 30 in the fitted state.

Referring to FIG. 12B, the arm portion 41 is provided with a notch 41*a* that is latched to an arm stopper 37 formed on the first piece 31*a* of the upper lid portion guide plate 31 and a projecting portion 41*b* that is inserted movably into the slit 33 formed in the upper lid portion guide plate 31. Hence, when the printing unit 40 rotated together with the upper lid portion 30 in the fitted state is withdrawn from the upper lid portion 30 and moved in a closing direction, the notch 41*a* formed in the arm portion 41 is latched to the arm stopper 37 formed on the first piece 31*a* of the upper lid portion guide plate 31. Thus, the printing unit 40 can be withdrawn from the upper lid portion 30 and supported independently thereof, as shown in FIG. 11, or in other words such that a working space is secured above and below the printing unit 40.

Further, in the fitted state where the printing unit 40 is fitted to the upper lid portion 30, the projecting portion 41*b* moves to the one end portion side of the upper lid portion guide plate 31 that is fixed to the upper lid portion 30, as shown in FIG. 13A, and when the printing unit 40 is withdrawn from the upper lid portion 30 and supported independently thereof, as shown in FIG. 11, the projecting portion 41*b* moves to the open end side of the upper lid portion guide plate 31, as shown in FIG. 13B.

When the projecting portion 41*b* inserted into the slit 33 moves to the one end portion side of the upper lid portion guide plate 31 that is fixed to the upper lid portion 30, as shown in FIG. 13A, elasticity is secured in the first piece 31*a* of the upper lid portion guide plate 31. Hence, when the upper lid portion 30 is closed, the upper lid portion stopper 34 is pressed by the edge portion of the opening 21 such that the first piece 31*a* deforms inwardly, thereby releasing the contact between the upper lid portion stopper 34 and the edge portion of the opening 21, and as a result, the closed state can be established.

When the projecting portion 41*b* inserted into the slit 33 moves to the open end side of the upper lid portion guide plate 31 as shown in FIG. 13B, on the other hand, the elasticity of the first piece 31*a* is inhibited by the projecting portion 41*b* positioned between the first piece 31*a* and the second piece 31*b* of the upper lid portion guide plate 31, and therefore the first piece 31*a* does not deform inwardly even when an attempt is made to close the upper lid portion 30. Accordingly, the contact between the upper lid portion stopper 34 and the edge portion of the opening 21 is not released, and therefore the closed state cannot be established.

Next, an attachment operation for attaching the ink ribbon 2 to the printing unit 40 according to this embodiment will be described.

To replace the roll sheet 3 or the ink ribbon 2, first, the upper lid portion 30 is opened from the closed state until it is supported by the upper lid portion stopper 34. Since the printing unit 40 is in the fitted state, the printing unit 40 is rotated together with the upper lid portion 30 such that the upper part of the supply portion 13 is opened, and it is therefore possible to perform an operation to replace the roll sheet 3.

Next, the printing unit 40 is withdrawn from the upper lid portion 30 and moved in the direction for closing the printing unit 40 until the notch 41*a* formed in the arm portion 41 is latched by the arm stopper 37 formed on the first piece 31*a* of the upper lid portion guide plate 31, whereby the printing unit 40 is withdrawn from the upper lid portion 30 and supported independently thereof, as shown in FIG. 11. As a result, parts above and below the printing unit 40 are opened, and therefore a space for replacing the ink ribbon 2 is secured (hereafter, a state in which the printing unit 40 is withdrawn from the upper lid portion 30 in the open state and the arm portion 41 is supported by the arm stopper 37 will be referred to as a ribbon replacement state). In the ribbon replacement state, a ribbon replacement operation is performed in the manner described above.

Note that when the ink ribbon 2 is removed or attached in the ribbon replacement state, force may be applied in a direction for closing the printing unit 40, but in this embodiment the printing unit 40 and the upper lid portion 30 do not close even if force is applied in a direction for closing the printing unit 40. More specifically, in the ribbon replacement state, the projecting portion 41*b* inserted into the slit 33 of the upper lid portion guide plate 31 is moved to the open end side of the upper lid portion guide plate 31, and therefore the elasticity of the first piece 31*a* is inhibited by the projecting portion 41*b* positioned between the first piece 31*a* and the second piece 31*b* of the upper lid portion guide plate 31. In other words, the first piece 31*a* does not deform inwardly, and therefore the contact between the upper lid portion stopper 34 and the edge portion of the opening 21 is not released even when an attempt is made to close the upper lid portion 30. As a result, neither the upper lid portion 30 nor the printing unit 40, the arm portion 41 of which is supported by the arm stopper 37 on the first piece 31*a* of the upper lid portion guide plate 31, can be shifted to the closed state.

The printing unit 40 is then fitted to the upper lid portion 30, and after checking the condition of the ink ribbon 2, which is suspended so as to pass the printing surface of the thermal head 12, the upper lid portion 30 is closed with the printing unit 40 in the fitted state. In the fitted state where the printing unit 40 is fitted to the upper lid portion 30, the contact member 36 provided in the upper lid portion 30 contacts the contacted end 53 of the ribbon cover 50 on the opposite side of the rotary shaft 51 such that the ribbon cover 50 is closed, and the projecting portion 41*b* inserted into the slit 33 is moved to the one end portion side of the upper lid portion guide plate 31 that is fixed to the upper lid portion 30. Hence, elasticity is secured in the first piece 31*a* of the upper lid portion guide plate 31 such that the first piece 31*a* can deform inwardly when the upper lid portion stopper 34 is pushed by the edge portion of the opening 21, and therefore the contact between the upper lid portion stopper 34 and the edge portion of the opening 21 can be released by closing the upper lid portion 30, whereby the closed state can be established.

As described above, this embodiment is provided with the upper lid portion stopper 34 (upper lid portion guide plate 31) that supports the open upper lid portion 30 in a predetermined position and releases support of the upper lid portion 30 when a closing direction force is exerted on the upper lid portion 30, the arm stopper 37 (upper lid portion guide plate 31) that supports the printing unit 40 such that a working space is secured above and below the printing unit 40 when the upper lid portion 30 is supported by the upper lid portion stopper 34, and the projecting portion 41*b* that prevents the support provided to the upper lid portion 30 by the upper lid portion stopper 34 and the support provided to the printing unit 40 by the arm stopper 37 from being released when the printing unit 40 is supported by the arm stopper 37, even if a closing direction force is exerted on the upper lid portion 30 and the printing unit 40, and therefore, in a case where an operation to replace the ink ribbon 2 is performed while the printing unit 40 is supported by the arm stopper 37 such that a working space is secured above and below the printing unit 40, the projecting portion 41*b* prevents the support provided to the upper lid portion 30 by the upper lid portion stopper 34 and the support provided to the printing unit 40 by the arm stopper 37 from being released. Hence, a situation in which the printing unit 40 and the upper lid portion 30 are closed unintentionally can be prevented from occurring even when a closing direction force is exerted on the printing unit 40 during replacement of the ink ribbon 2, and as a result, the operation to replace the ink ribbon 2 is not obstructed.

Furthermore, according to this embodiment, the function of the projecting portion 41*b* as release preventing means is canceled by opening the printing unit 40 toward the upper lid portion 30 from the state in which the printing unit 40 is supported by the arm stopper 37 (the upper lid portion guide plate 31), and therefore, following replacement of the ink ribbon 2, the function of the projecting portion 41*b* as release preventing means can be canceled by a simple operation of opening the printing unit 40 toward the upper lid portion 30, whereby the upper lid portion 30 can be set in a closeable state. Further, by opening the printing unit 40 toward the upper lid portion 30, the printing surface of the thermal head 12 becomes visible, and therefore a user can be encouraged to check whether the ink ribbon 2 is suspended correctly.

Note that the present invention is not limited to the embodiments described above, and the embodiments may be modified appropriately within the scope of the technical spirit of the present invention. Further, numbers, positions, shapes, and so on of the constitutional members described above are not limited to those of the embodiments and may be set at suitable numbers, positions, shapes and so on for implementing the present invention. Note that in the drawings, identical constitutional elements have been allocated identical reference symbols.

The invention claimed is:

1. A printer that performs printing by overlapping a printing medium and an ink ribbon, the printer comprising:

a ribbon winding shaft and a ribbon supply shaft positioned and configured for suspending the ink ribbon therebetween, a platen roller and an opposing print head positioned for the ink ribbon and the printing medium to pass between them, devices for conveying said printing medium and said ink ribbon together between said platen roller and said print head in a sandwiched fashion;

a printer main body having an upper portion, an upper lid portion covering said upper portion of said main body, a printing unit including said print head, said ribbon winding shaft and said ribbon supply shaft, said printing unit is disposed between said main body and said upper lid portion a common support shaft supporting said upper lid portion and said printing unit to be on said upper portion of said main body configured such that each of said upper lid portion and said printing unit is free to rotate relative to each other to open space for enabling replacement of said printing medium and said ink ribbon after opening of said upper lid portion and said printing unit around said support shaft;

an upper lid portion support configured for supporting said upper lid portion in a first rotated position relative to said main body and for releasing support of said upper lid portion when a closing direction force is exerted on said upper lid portion;

a printing unit support configured for supporting said printing unit in a second rotated position relative to and on said main body independent of said upper lid portion at a smaller rotated angle than said first rotated position of said upper lid portion and for releasing support of said printing unit when a closing direction force is exerted on said printing unit; and a connecting device configured for connecting said upper lid portion and said printing unit in a fitted state wherein said printing unit is fitted to said upper lid portion, wherein said upper lid portion and said printing unit are connected by said connecting device when said upper lid portion and said printing unit are closed on said main body and wherein said upper lid portion and said printing unit are disconnected when said printing unit is in said second rotated position and said upper lid portion is in said first rotated position.

2. The printer according to claim 1, wherein said connecting device releases a connection of said connecting device between said upper lid portion and said printing unit when said printing unit is withdrawn from said upper lid portion while said upper lid portion and said printing unit are relatively rotated open to respective positions thereof with respect to said main body.

3. The printer according to claim 1 wherein said upper lid portion support comprises:

a first arc-shaped member, having one end portion fixed to said upper lid portion and having an open end side inserted into an opening formed in said main body, said first arc-shaped member being divided, by a first slit formed from said open end side toward said one end portion dividing said first arc-shaped member into a first piece which has elasticity and which is formed with an upper lid portion stopper that is configured and positioned to support said upper lid portion at said first rotated position rotated open from said main body, said supporting of said upper lid portion is by said upper lid portion stopper contacting an edge portion of said opening, and said arc-shaped member is also divided by said first slit into a second piece extending along said first slit and spaced by said first slit from said first piece, and said printing unit support comprises a second arc-shaped member, having one end portion fixed to said printing unit and having an open end inserted into an opening formed in said main body, said second arc-shaped member being divided, by a second slit formed from said open end side toward said one end portion dividing said second arc-shaped member into a first piece which has elasticity and which is formed with a printing unit stopper and which is configured and positioned to support said printing unit at said second rotated position rotated open from said main body, said supporting of said printing unit is by said printing unit stopper contacting a respective edge portion of said opening, and said second arc-shaped member is also divided by said second slit into a second piece extending along said second slit and spaced by said second slit from said first piece.

4. The printer according to claim 1, wherein the printer is a thermal printer and the print head is a thermal print head.

* * * * *